US005109996A

United States Patent [19]

Sullivan

[11] Patent Number: 5,109,996

[45] Date of Patent: May 5, 1992

[54] NURSING BOTTLE ASSEMBLY WITH MEANS TO REMOVE AIR

[76] Inventor: Charles J. Sullivan, 1500 Wagonwheel Dr., Henderson, Nev. 89015

[21] Appl. No.: 701,469

[22] Filed: May 15, 1991

[51] Int. Cl.[5] ..... A61J 9/00

[52] U.S. Cl. ..... 215/11.6; 215/11/1; 215/11.3

[58] Field of Search ..... 215/11.3, 11.6, 11.1, 215/100 R

[56] References Cited

U.S. PATENT DOCUMENTS

| | | | |
|---|---|---|---|
| 3,143,429 | 8/1964 | Swanson et al. | 99/171 |
| 3,243,069 | 3/1966 | Duerme | 215/11.5 |
| 3,627,161 | 12/1971 | Wergeland | 215/11.6 |
| 3,648,873 | 3/1972 | Grobbel | 215/11.3 |
| 3,998,348 | 12/1976 | Sammaritano | 215/11.3 |
| 4,010,861 | 3/1977 | Welten | 215/11.5 |
| 4,176,754 | 12/1979 | Miller | 215/11.3 |
| 4,339,046 | 7/1982 | Coen | 215/11.5 |
| 4,880,125 | 11/1989 | Lebeau | 215/11.3 |
| 4,979,629 | 12/1990 | Askerneese | 215/11.6 X |

*Primary Examiner*—Sue A. Weaver
*Attorney, Agent, or Firm*—Quirk, Tratos & Roethel

[57] ABSTRACT

A nursing bottle assembly of the type in which a collapsible liquid sack having an open end and a closed end and is contained in a protective tube open at both ends that is provided with a plunger for expelling air from a collapsing liquid containing sack. The open top end of the sack is clamped by a nipple mounting cap to one end of the tube. The hollow cylindrical plunger can be inserted into the open end of the protective outer tube opposite its nipple carrying end. Any time liquid is being or has been withdrawn from the sack, the plunger may be manipulated by manual pressure to compress the sack toward the nipple end of the tube to reduce the volumetric capacity of the sack between its closed end and the nipple to prevent any air from accumulating in the sack space vacated by the removed liquid.

2 Claims, 4 Drawing Sheets

NURSING BOTTLE ASSEMBLY WITH MEANS TO REMOVE AIR

This invention relates to a an inner lining nursing bottle assembly of the type utilizing replaceable collapsible sacks for holding infant feeding fluids, and more particularly to a hollow plunger used to assist the collapsing of the sack after milk, baby formula or any other fluid contained in the sack has been withdrawn through the nipple by the suckling infant.

BACKGROUND OF THE INVENTION

As a matter of personal preference or as a matter of convenience, many mothers resort to bottle feeding of their infants for the first years of the child's life. During the 1960's the hard glass bottles that were capped by nipples were gradually replaced by collapsible flexible sacks. The sacks preferably were replaceably mounted in a tubular frame for protection during use. Provision was made for coupling the sacks to nipples. For sanitary reasons, the sacks were intended to be disposable after a single use.

Collapsible sack nursing bottle assemblies have been advertised as reducing the amount of air ingested into an infant's stomach when the liquid baby food is drawn through the nipple from the nursing bottle. Under certain conditions, the use of collapsible sack nursing bottles can have complications. If only one of two ounces of fluid is has been withdrawn from the sack by the infant, forcing the air out of the sack with finger pressure becomes somewhat difficult. Or, if the feeding of the infant is interrupted and the nursing bottle is laid down for a few moments, there can be a reverse flow of air through the nipple into the fluid sack. Preferably, when the bottle is picked up to resume the feeding, the air in the sack should be evacuated before liquid is drawn through the nipple by the infant. Again, the application of finger pressure to the sack to force any air out becomes somewhat difficult.

Various solutions to the problem of forcing air from a nursing bottle sack partially filled with liquid baby food can be found in the prior art (see, for example, U.S. Pat. Nos. 3,648,873; 3,998,348; 4,010,861 and 4,339,046).

It is an object of the present invention to provide a simplified device operable to remove air from collapsible and dispensable plastic sacks used in nursing bottle assemblies from partially filled sacks or after any portion of the liquid baby food has been withdrawn from the sack by the nursing infant.

It is a further object to provide an air displacing device in the form of a hollow plunger that can be inserted into the nursing bottle assembly from the bottle end opposite the end on which the nipple is mounted to apply pressure on the collapsible sack to force the air therefrom.

It is yet a further object of the invention to provide an air displacing plunger that can be stored within a nursing bottle assembly when not in use.

It is a still further object of the invention to provide an air displacing plunger that has a cavity therein opening from the bottom end in which liquid holding sacks, nipples, wipes and miscellaneous small items may be stored.

It is still a further object to provide a cap to close the cavity in the plunger. With the cap on the bottom, the plunger becomes free standing.

These and other objects of the invention will be apparent from the following disclosure of a preferred embodiments of the present invention.

SUMMARY OF THE INVENTION

The present invention relates to nursing bottle assemblies of the type in which a collapsible liquid baby food sack having an open end and a closed end is contained in a protective cylindrical tube open at both ends. The open end of the food sack is clamped by a threaded nipple mounting cap to one end of the tube. A hollow cylindrical plunger of lesser diameter than the protective tube can be inserted into the open end of the protective outer tube opposite its nipple carrying end. Any time liquid baby food is inserted into the sack of the bottle assembly a certain amount of unwanted air will be present. While the bottle assembly is in an upright position, the plunger may be inserted into the open end of the protective tube opposite the end on which the nipple is mounted and manipulated to apply manual pressure to compress the sack to force unwanted air through the nipple feeding opening. This procedure can be repeated any time during the feeding period if unwanted air regains access to the sack.

BRIEF DESCRIPTION OF THE DRAWINGS

Further features and advantages of the present invention will be made more apparent as this description proceeds, reference being had to the accompanying drawings, wherein.

DETAILED DESCRIPTION OF THE PREFERRED EMBODIMENTS

Figure 1:
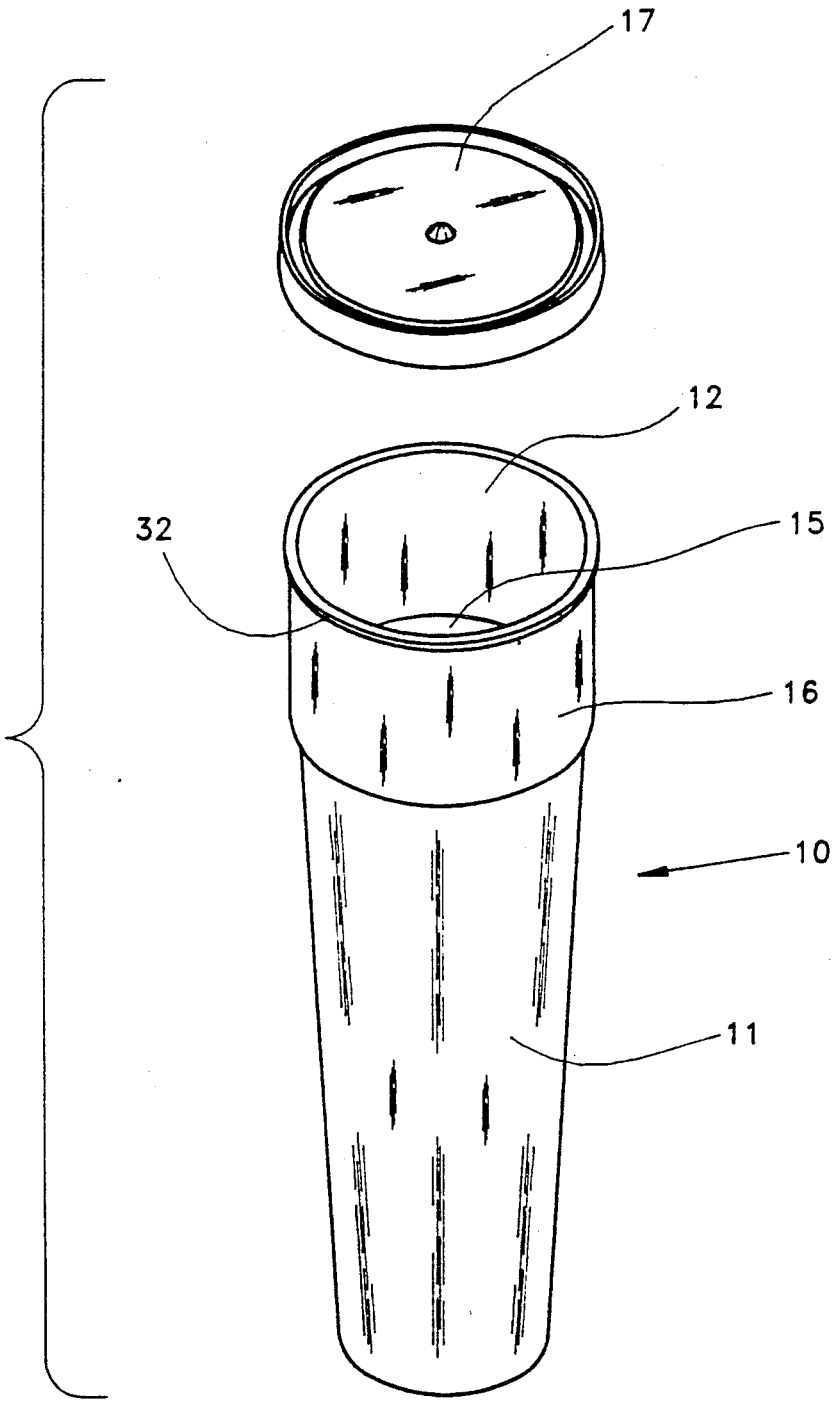
FIG. 1 is an exploded perspective view of a plunger and a cap for one end thereof embodying the present invention.
Figure 2:
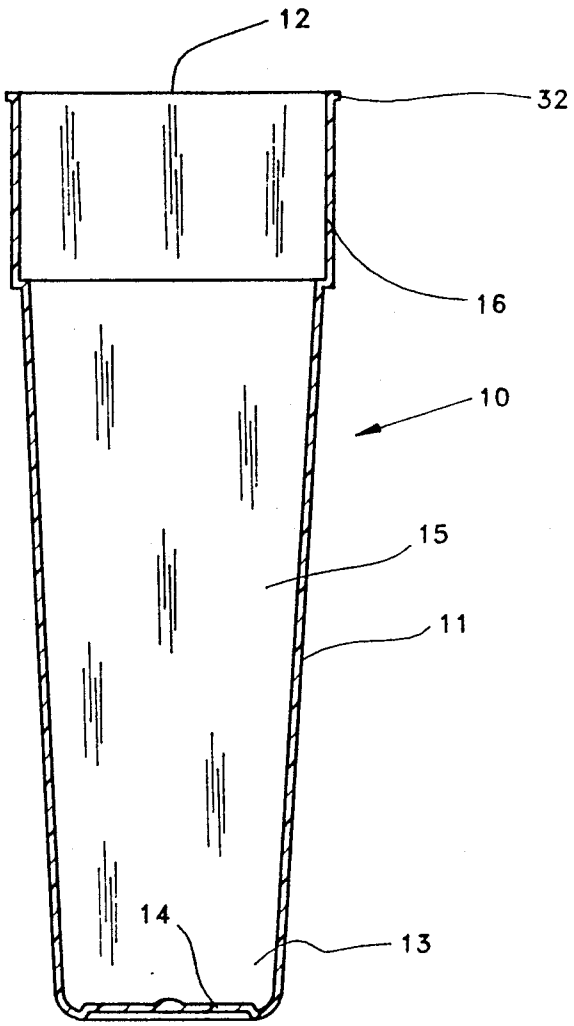
FIG. 2 is a longitudinal vertical section of the plunger.

As best seen in FIGS. 1 and 2, the plunger embodying the present invention is shown generally 10. The body 11 of plunger 10 is an elongated hollow, thin walled plastic tube of circular cross section. The hollow plunger body 11 has an open first end 12 and a closed second end 13 which is closed by a transverse end wall 14 opposite the first end 12. The open first end 12 provides access to the hollow interior or cavity 15 of the plunger body 11.

Adjacent its first end 12, the plunger 10 is provided with an external cylindrical shoulder portion 16. In the preferred embodiment, between the shoulder portion 16 and its closed second end 13, the plunger body 11 is uniformly tapered so that at its closed second end 13 it is of lesser diameter than at its open first end 12.

Figure 3:
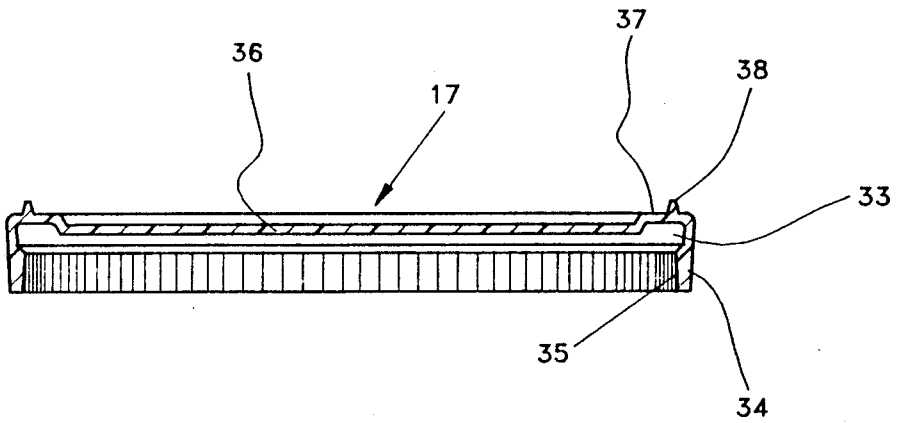
FIG. 3 is vertical section of a cap for the open end of the plunger.

A cap 17, see FIGS. 1 and 3, is provided as a closure for the open first end 12 of the plunger and thereby the cavity 15 in the plunger body 11.

Figure 4:
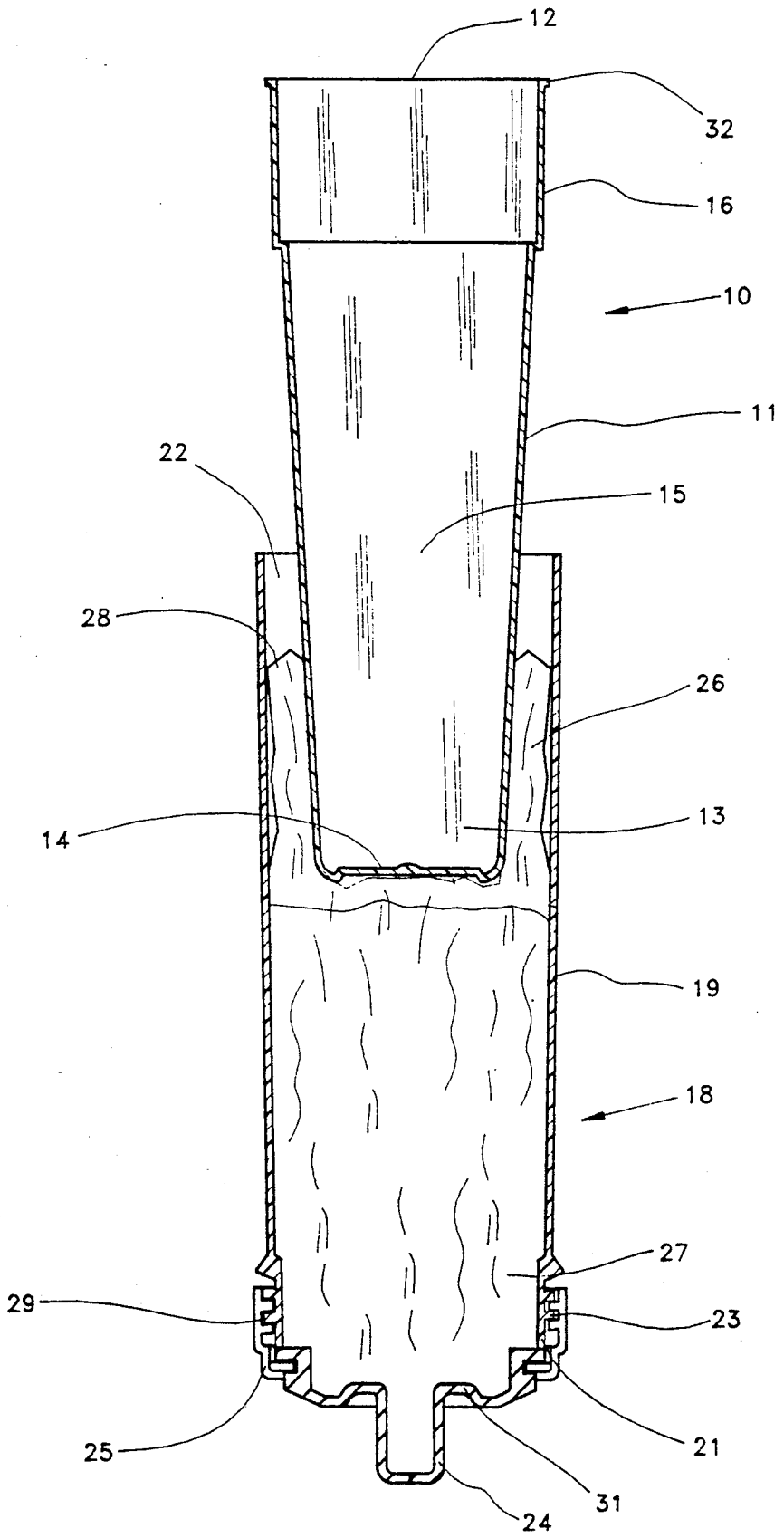
FIG. 4 is a vertical section of a nursing bottle assembly with the plunger of the present invention partially inserted into the tube containing a partially filled liquid baby food sack.

The utility of plunger 10 is best described with reference to FIG. 4 in which a conventional nursing bottle assembly, generally designated 18, is illustrated. There are a number of commercially available nursing bottle units. Basically, they all comprise an elongate plastic protective tube or cylinder 19 open at both its nipple end 21 and the opposite end 22. At the nipple end 21, the protective tube 19 preferably has external threads 23 on which a nipple retaining collar 25 is threaded.

A thin collapsible plastic sack 26 having an open top end 27 and a closed bottom end 28 is fitted within the tube 19. A marginal top end portion 29 of the sack 26 is draped over the threads 23 on the protective tube 19. The sack 26 is manually gripped as the liquid baby food is poured into it to the desired depth. Then the nipple mounting collar 25 with a nipple 24 inserted therein is threaded onto the threads 23 to firmly grip and seal the top end portion 29 of the sack 26 to the protective tube 19.

If only an ounce or two of liquid baby food is initially poured into a sack 26 that could hold up to eight ounces of liquid, the infant may be withdrawing mostly air through the nipple 24. If the sack 26 initially is filled to capacity with liquid, as soon as the infant starts drawing liquid from the sack 26, a vacuum is created in the sack. If the nursing bottle is held upright while the liquid is being drawn out of the sack 26, very little air will be drawn into the infant's stomach. But if the bottle is tilted while its contents are being fed to the infant or if the bottle is placed in an upright position during an interruption in the feeding operation, there could be a reverse flow of air drawn into the bottle through the nipple 24. Upon resumption of the feeding, the air in the bottle then could be ingested by the infant along with the liquid baby food.

The problem of unwanted air in the nursing bottle is readily solved by using the plunger 10. To evacuate any air in the sack 26, it is only necessary to insert the plunger 10 into the protective tube 19 while the latter is held substantially upright. The plunger 10 must be inserted to a depth at which the transverse wall 14 of the plunger end 13 contacts the closed bottom end 28 of the sack 26. Then the application of manual pressure downwardly on the tube 19 or upwardly on the plunger 10 to close the gap between the plunger transverse end wall 14 and the base 31 of the nipple 24 will result in any air in the sack 26 being forced out through the nipple 24. When the plunger end wall 14 presses the thin material of the closed end 28 of the sack 26 against the base 31 of the nipple 24, as depicted in FIG. 5, any air that may be in the bulb of the nipple 24 or trapped in the folds of the sack 26 between the plunger end and the protective tube 19 will be of little consequence since all fluid flow through the nipple 24 would be cut off.

The plunger body 11 at its open first end 12 comprises a flat base that lies in a plane perpendicular to the longitudinal axis of the mandrel body 11. The flat base allows the freestanding position. This provides a convenient stand on which to place the nursing bottle assembly when, for some reason, it becomes necessary to interrupt the feeding of the infant.

If the nursing bottle assembly 18 is set down in a position that permits the sack 26 to fill up with air to replace the liquid that has been withdrawn, the air easily can be expelled from the sack 26. With the upright plunger 10 at hand it only becomes necessary to place the end 22 opposite the nipple end 24 the protective tube 19, with the sack 26 containing the balance of the liquid, over the plunger with the closed bottom end 28 of the sack 26 abutting the transverse wall 14 of the closed end 13 of the plunger 10. With the application of slight downward pressure on the protective tube 19, the plunger 10 forces the air out of the nipple 24 in a matter of seconds, and the feeding of the infant can resume without delay after the reason for the interruption of the feeding has been handled.

Figure 5:
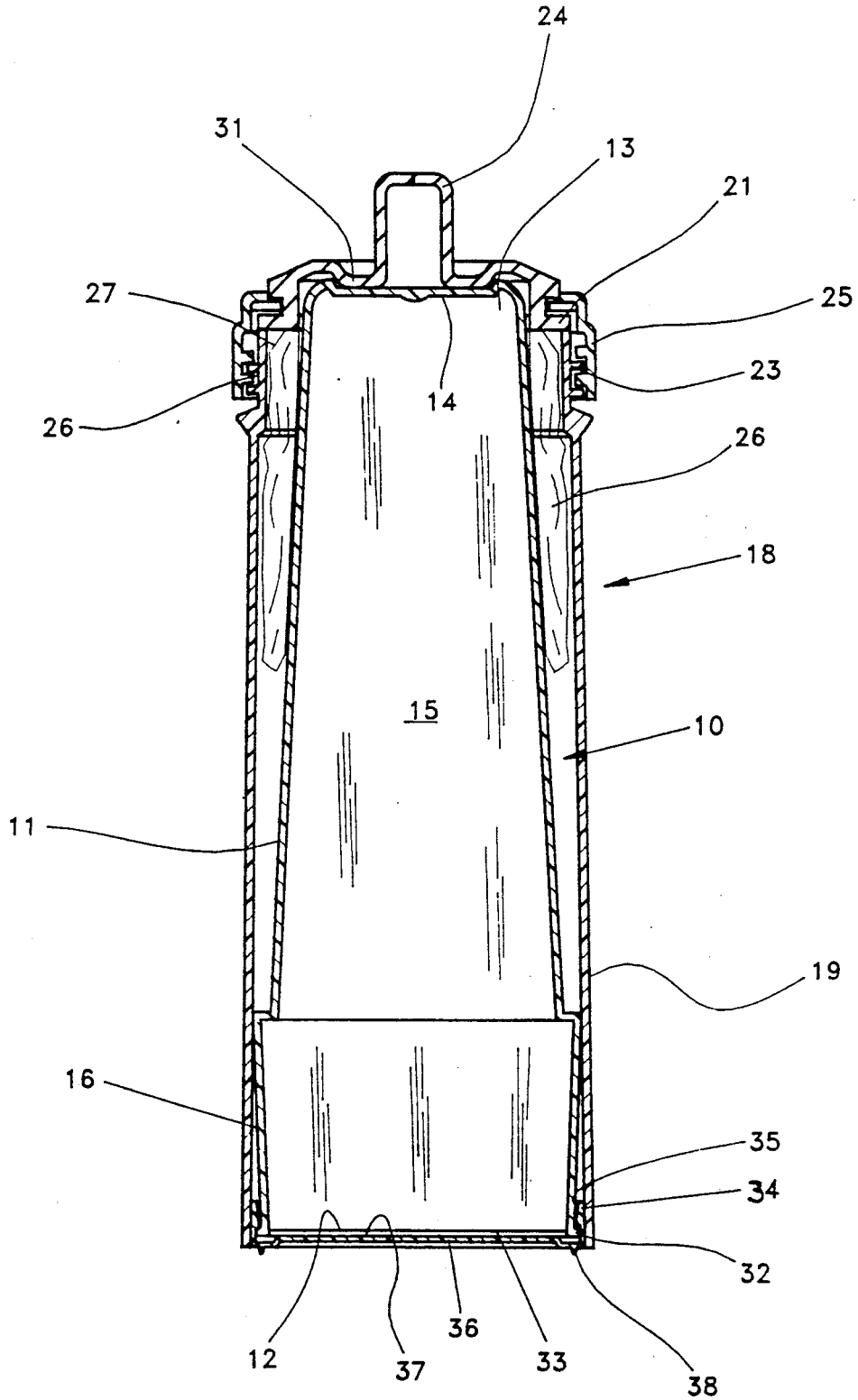
FIG. 5 is a vertical section of a nursing bottle assembly with the assembled components inverted from the positions shown in FIGS. 1 to 4 without any liquid baby food in the sack but with a plunger fully inserted for temporary storage purposes.

As illustrated in FIG. 5, the tapered configuration of the plunger body 11 accommodates the collapsed sides of the sack 26 and permits the transverse wall 14 of the plunger body 11 to abut the base 31 of the nipple 24 when the plunger body 11 is entirely fitted into the protective tube 19. The length of the plunger body 11 is slightly less than the interior length of the protective tube 19. This provides a convenient storage place for the plunger 10 when the nursing bottle assembly 18 is not being used.

The hollow interior 15 of the plunger body 11 also provides a convenient storage place for a supply of baby accessory items such as liquid food sacks, nipples, baby wipes and so forth.

The plunger shoulder portion 16 has an external diameter less than the interior diameter of the tube 19 to provide a slip fit clearance for guiding the plunger movement within the protective tube 19.

The cap 17 disclosed in FIG. 3 is configured to fit over the end 12 of the plunger body 11. The plunger has a small out-turned lip or flange 32 adapted to be snapped into a circular pocket or recess 33 at the base of a circular sidewall 34 on the cap 17. The sidewall 34 has a tapered interior surface 35 into which the end 12 of the plunger is fitted. The plunger is pressed down until its end 12 abuts on the cap bottom wall 36. On the exterior 37 of the cap bottom wall 36 is a circular rib 38 on which the bottle assembly can be stood upright when not in use. The exterior surface of the cap sidewall 34 is sized to be press fit into the end of the protective tube 19 to a depth that will leave the circular rib 38 exposed when the parts are assembled.

While the invention has been illustrated with respect to a specific embodiment thereof, this embodiment should be considered illustrative rather than limiting. Various modifications and additions may be made and will be apparent to those skilled in the art. Accordingly, the invention should not be limited by the foregoing description, but rather should be defined only by the following claims.

What is claimed is:

1. An improved nursing bottle assembly of the type in which a collapsible sack for holding liquid has an open nipple end and a closed opposite end and is inserted into a protective tube that is open on both its first end and its second end, and in which a nipple is secured to a nipple mounting cap that is threaded on the first end of the protective tube to support the collapsible sack in the protective tube and to close the open nipple end of the collapsible sack, wherein the improvement comprises:

a hollow plunger sized to be slidably inserted into the second end of the protective tube, the plunger having a closed end and an open end, the open end providing access to a cavity in the plunger, the closed end of the plunger having smaller diameter than the internal diameter of the second end of the protective tube, the plunger being slidable within the protective tube from a first position at which the closed end of the plunger initially abuts the closed end of the protective sack to a second position in which the plunger causes the closed end of the protective sack to abut the nipple mounting cap, the plunger having an external cylindrical shoulder portion adjacent its open end and extending toward its closed end, the external cylindrical shoulder portion being sized to loosely fit into the open end of the protective tube, and the plunger further having a tapered body portion of decreasing diameter extending between its shoulder portion and its closed end to minimize interference between the plunger, the collapsible sack and the protective tube as the plunger is shifted in a direction to maintain contact between its closed end and the closed end of the sack and the sack collapses toward the nipple mounting cap upon withdrawal of the liquid, whereby, as liquid is withdrawn from the protective sack through the nipple, the plunger can be shifted by manual pressure toward the first end of the protective tube to compress the fluid containing portion of the sack between the nipple and the closed end of the collapsing sack to prevent air accumulation in the sack space vacated by the removed liquid.

2. An improved nursing bottle assembly according to claim 1, in which the external cylindrical shoulder portion of the plunger has an external diameter less than the internal diameter of the protective tube to provide a slip fit clearance for centering the plunger within the protective tube.

* * * * *